US006991184B2

(12) United States Patent
Romaine

(10) Patent No.: US 6,991,184 B2
(45) Date of Patent: Jan. 31, 2006

(54) SHOWER RINSE SYSTEM

(76) Inventor: Dell Romaine, 1720 E. 9th St., Hopkinsville, Christian County, KY (US) 42240

( * ) Notice: Subject to any disclaimer, the term of this patent is extended or adjusted under 35 U.S.C. 154(b) by 153 days.

(21) Appl. No.: 10/438,620

(22) Filed: May 15, 2003

(65) Prior Publication Data

US 2003/0213061 A1 Nov. 20, 2003

Related U.S. Application Data

(60) Provisional application No. 60/381,095, filed on May 17, 2002.

(51) Int. Cl.
*B05B 7/30* (2006.01)

(52) U.S. Cl. ..... 239/318; 239/67; 239/282; 239/310; 239/407; 239/413; 4/597

(58) Field of Classification Search ..... 239/67, 239/69, 68, 310, 318, 282, 407, 413; 4/596, 4/597

See application file for complete search history.

(56) References Cited

U.S. PATENT DOCUMENTS 4,029,260 A * 6/1977 Herrick ..... 239/282
5,174,503 A * 12/1992 Gasaway ..... 239/318
6,455,017 B1 * 9/2002 Kasting et al. ..... 239/318

* cited by examiner

*Primary Examiner*—Steven J. Ganey
(74) *Attorney, Agent, or Firm*—Gary K. Price, Esq.

(57) ABSTRACT

A controlled shower rinse system installed in a shower stall that provides a means to mix a selected product, like a medicated shampoo or chemical for example, with the water that flows from the conventional shower head of a shower device. The rinse system including a flow injector for effectively blending water from a water supply system and the medicated product and directing the blended water to the shower head of the shower device, a solenoid valve for regulating the introduction of the medicated substance to the flow injector, and a push button operably associated with the rinse system to supply a control signal to the valve for causing operation thereof.

15 Claims, 2 Drawing Sheets

SHOWER RINSE SYSTEM

CROSS REFERENCES TO RELATED APPLICATIONS

U.S. Provisional Application for Patent 60/381,095, filed May 17, 2002, with title, "Shower Rinse System", which is hereby incorporated by reference. Applicant claims priority pursuant to 35 U.S.C. par. 119(e)(i).

STATEMENTS AS TO RIGHTS TO INVENTIONS MADE UNDER FEDERALLY SPONSORED RESEARCH AND DEVELOPMENT.

Not applicable.

BACKGROUND OF THE INVENTION

1. Field of the Invention

This invention relates to a shower rinse system for use in prisons and like facilities, and more particularly, a shower rinse system installed in shower stalls that provides a means to mix a selected product, like a medicated shampoo or other chemical for example, with the water that flows from the conventional shower head of a shower device.

2. Brief Description of Prior Art

Many penal institutions, such as prisons, jails and the like require in-coming inmates for example, to shower when the inmate is initially incarcerated. It is further common for the institution to require the inmate to apply certain cleansing and/or medicated products during the shower process. While soap or the like is conventionally available for cleansing, stronger materials such as medicated shampoo or other chemicals are often required during the shower in order to effectively cleanse and remove any parasites and their eggs that may infest the skin or hair. It is obviously necessary for each inmate to achieve such a cleansing prior to that inmate joining the institution's population.

Officers working in the penal institution will often supply a selected amount of any such medicated product to the inmate just prior to the inmate entering the shower. The inmate is then instructed to manually apply the product during the shower. Obviously if the inmate applies the product improperly or intentionally avoids applying the product the risk exists that the inmate remains infested, and may therefore infest other inmates. As a result, the officer is required to monitor the inmate during the shower process in order to verify that the inmate applied the medicated product properly. Such monitoring is time consuming for the officer and a misuse of the institution's employee resources. Further, human mistake and oversight by the officer is possible resulting in the inmate remaining infested and therefore infesting the prison population.

As will be seen from the subsequent description, the preferred embodiments of the present invention overcome these and other shortcomings of prior art.

SUMMARY OF THE INVENTION

This present invention is a shower rinse system for use in prisons and like facilities, and more particularly, a shower rinse system installed in shower stalls that provides a means to mix a selected product, like a medicated shampoo or other chemical for example, with the water that flows from the conventional shower head of a shower device. The preferred embodiment includes a flow injector attached to the shower head, a solenoid valve, and a push-button switch.

DESCRIPTION OF THE PREFERRED EMBODIMENT

Figure 1:
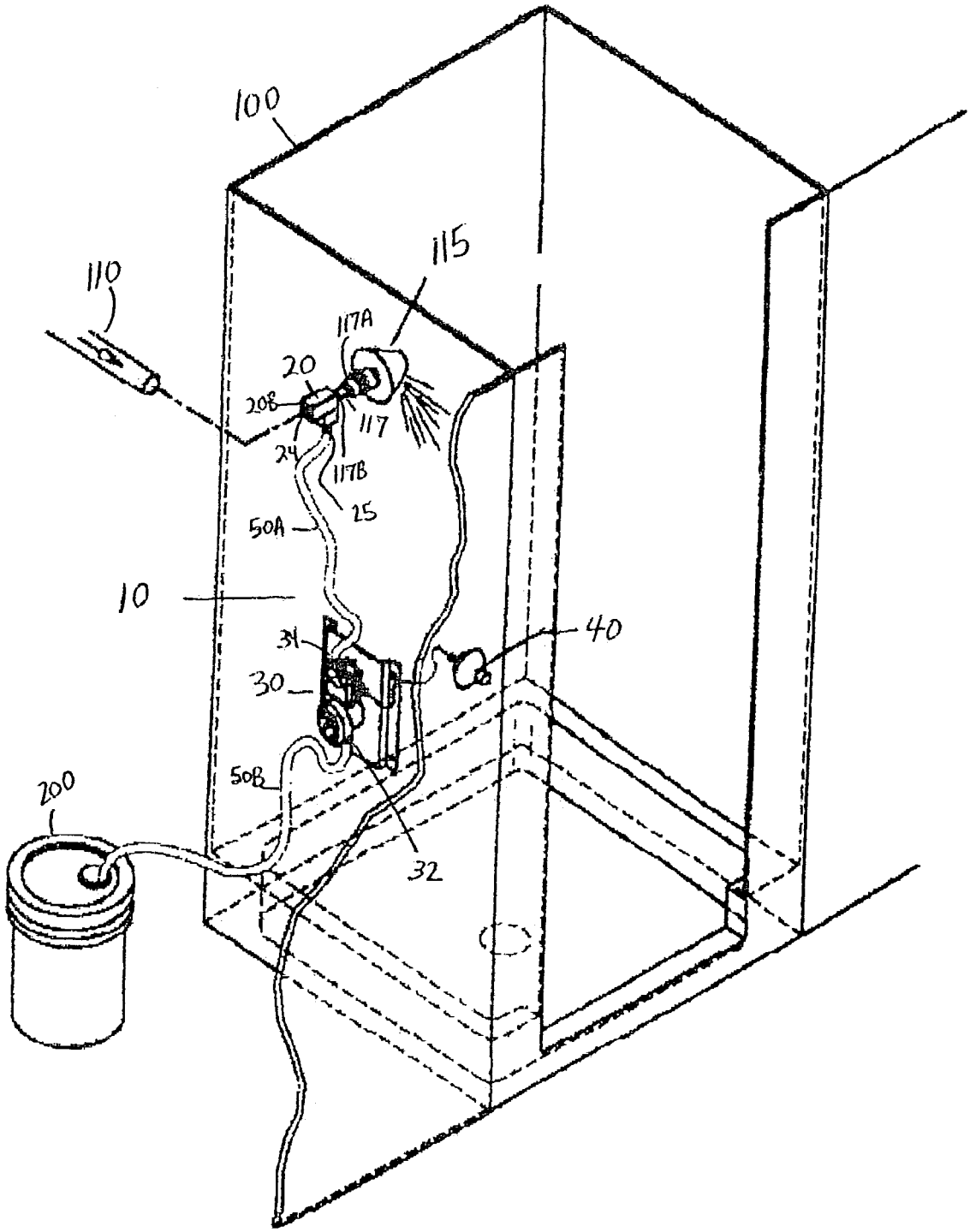
FIG. 1 is a perspective view of a preferred embodiment of the present invention, a shower rinse system attached to a conventional shower device.
Figure 2:
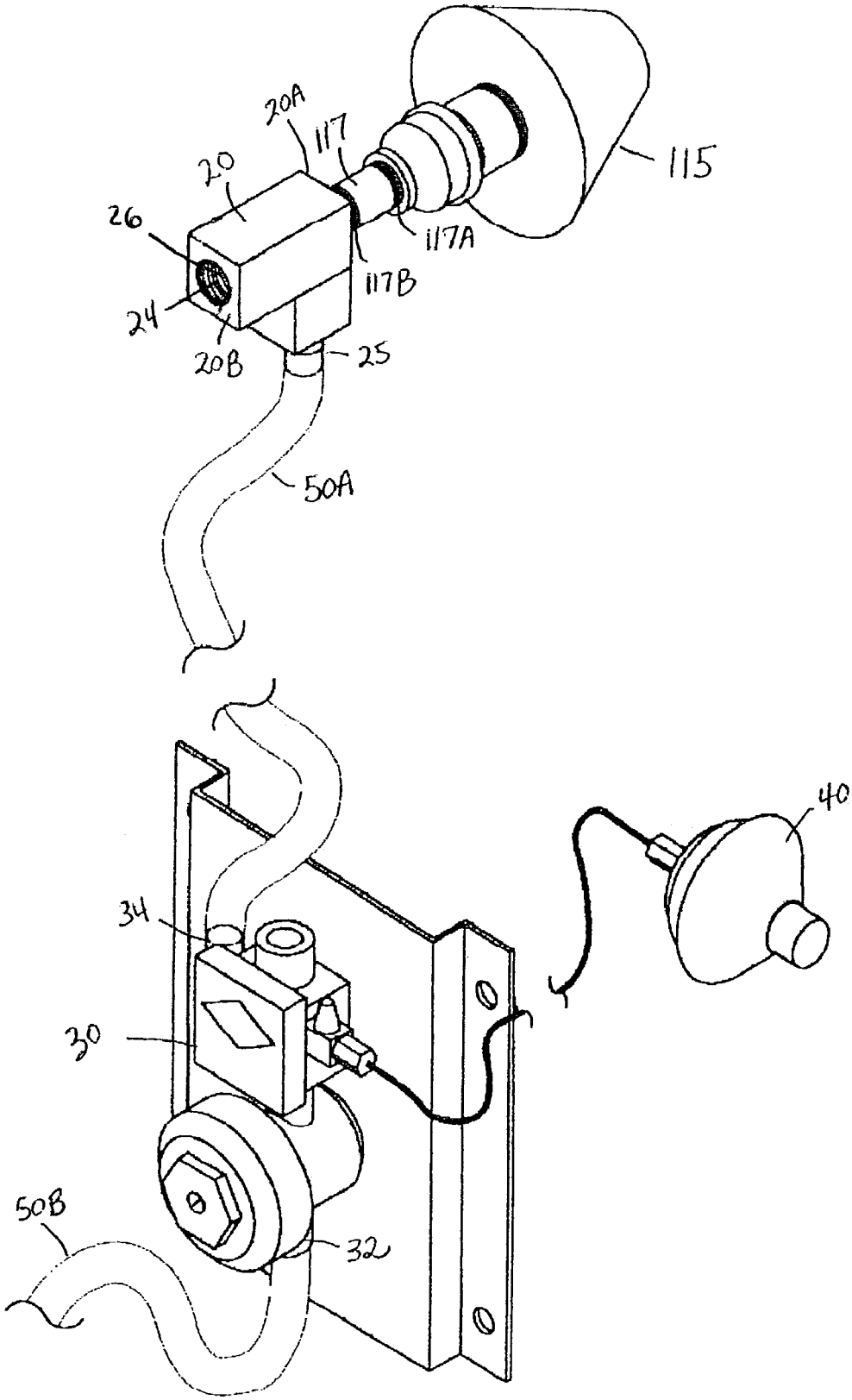
FIG. 2 is a perspective view of the components of the preferred embodiment of the present invention, namely, an injector attached to a conventional shower head, a solenoid valve, and a push-button switch.

FIGS. 1–2 illustrate a preferred embodiment of a shower rinse system 10 made in accordance with the present invention. The present invention may be used in prisons and like facilities, and generally, is installed in a shower stall 100 and provides a means to mix a selected product 200, like a medicated shampoo or other chemical for example, with the water that flows from a conventional water supply line 110 through a shower head 115 of a shower device.

As best shown in FIG. 2, the shower rinse system 10 generally including a flow injector 20, a solenoid valve 30, and a push-button switch 40.

As best shown in FIG. 1, the shower stall 100 has the water supply line 110 and the shower device including the shower head 115 attached to a shower arm 117 that projects outwardly through the wall of the shower stall 100. The shower arm 117 having threaded ends 117A and 117B, the threaded end 117A for threadably mounting the shower arm 117 to the shower head 115, and the threaded end 117B opposite the threaded end 117A for generally mounting the shower arm 117 to the flow injector 20 as will be discussed. The shower stall 100 and shower device is conventional in design.

Referring to FIG. 2, the flow injector 20 including a first end 20A and a second end 20B opposite the first end 20A. The flow injector 20 further including a first threaded bore (not shown) disposed in the first end 20A for threadably mounting the flow injector 20 to the threaded end 117B of the shower arm 117; and a second threaded bore 24 disposed in the second end 20B for threadably mounting the flow injector 20 to the water supply line 110. The first threaded bore and the second threaded bore of the flow injector 20 defining a passage 26 in the injector 20 for fluid communication between the second threaded 24 bore and the first threaded bore.

The flow injector 20 further includes an inlet 25 for receiving the selected chemical product 200 as will be further discussed. The inlet 25 being in fluid communication with the passage 26 defined within the injector 20. An example of an acceptable flow injector 20 is a single-stage injector manufactured by ROMA.

During use, water from the water supply line 110 is directed continuously into the flow injector 20. The water flows through the passage 26 of the flow injector 20 and to the shower arm 117. The water is then disbursed from the shower head 115. While water is flowing through the flow injector 20 as discussed above, the chemical product 200 is selectively introduced to the flow injector 20 through the inlet 25. The flowing water effectively blends with the introduced product 200 within the flow injector 20 and disburse from the shower head 115.

The solenoid valve 30 controls release of a predetermined volume of the chemical product 200 to the inlet 25 of the flow injector 20. As those skilled in the art will appreciate, the valve 30 is operated in response to a control signal. The valve 30 is normally closed, so that failure of the control means will prevent constant chemical products 200 from issuing to the flow injector 20. A manual push-button switch 40 is remotely located from the shower stall 100 and the system 10. In this way, control of the switch 40 is preferably not available or accessible to the inmate and, chemical products 200 can be selectively supplied to the flow injector 20 and therefore disbursed from the shower head 115. An acceptable solenoid valve 30 is known in the art and available by many manufacturers.

As shown in FIG. 1, the solenoid valve 30 is preferably mounted to the back side of the wall of the shower stall 100. The valve 30 includes an inlet port 32 and an outlet port 34, the inlet port 32 for receiving the chemical products 200 and the outlet port 34 for ejecting the chemical products 200 and directing the products 200 to the inlet 25 of the flow injector 20 as described above.

The system 10 further includes first and second flow tubes 50A and 50B, the flow tubes 50A, 50B are known in the art. One end of the first flow tube 50A is connected to the inlet 25 of the flow injector 20, and the opposite end of the first flow tube 50A is connected to the outlet port 34 of the solenoid valve 30 so that the flow injector 20 is in fluid communication with the solenoid valve 30. One end of the second flow tube 50B is connected to the chemical products 200 supply source, and the opposite end of the second flow tube 50B is connected to the inlet port 32 of the solenoid valve 30 so that the chemical products 200 supply source os in fluid communication with the solenoid valve 30. Appropriate plumbing interconnects the first and second flow tubes 50A, 50B as described above.

An acceptable push button switch 40 is known in the art. The switch 40 is preferably an air operated switch, however an electric switch or other mechanical switch would be acceptable.

Although the description above contains many specificities, these should not be construed as limiting the scope of the invention but as merely providing illustrations of a presently preferred embodiment of this invention.

Thus the scope of the invention should be determined by the appended claims in the formal application and their legal equivalents, rather than by the examples given.

I claim:

1. A shower rinse system that blends a selected product with water and directs the blended solution through a shower head of a shower device, said shower rinse system comprising:

a shower stall, a shower head contained within said shower stall, a flow injector having an inlet, and a first and second end defining a passage, wherein the first end is attached to one end of a shower arm and the opposite end of the shower arm is mounted to said shower head, and wherein the second end of the flow injector is connected to a water supply line, a valve mounted exterior to said shower stall and having an inlet port and an outlet port, a control means mounted exterior to said shower stall and connected to the valve, a first flow tube wherein a first end of the first flow tube is connected to the inlet of the flow injector and a second end of the first flow tube is connected to the outlet port of the valve, a second flow tube wherein a first end of the second flow tube is connected to a product supply source located exterior to said shower stall and a second end of the second flow tube is connected to the inlet port of the valve.

2. The shower rinse system as recited in claim 1, wherein the valve is a solenoid valve.

3. The shower rinse system as recited in claim 1, wherein the control means is a push-button switch.

4. The shower rinse system as recited in claim 3, wherein the control means is remotely located from the shower device.

5. The shower rinse system as recited in claim 1, wherein the valve releases a predetermined volume of the product to the inlet of the flow injector.

6. The shower rinse system as recited in claim 5, wherein the control means transmits a signal to the valve to release said predetermined volume of the product.

7. A shower rinse system comprising:

a flow injector having a first end in fluid communication with a shower head, a second end connected to a water supply line, and an inlet in fluid communication with a valve, the flow injector further defining an interior bore extending the length of the flow injector, said interior bore in fluid communication with the valve, and control means connected to the valve, wherein the valve is in fluid communication with a product supply source to deliver a predetermined volume of the product to the inlet of the flow injector, wherein the control means is a push-button switch, and wherein said control means is mounted on a wall remotely located from the shower device.

8. The shower rinse system as recited in claim 7, wherein the value is a solenoid valve.

9. The shower rinse system as recited in claim 7, wherein the control means transmits a signal to the valve to release said predetermined volume of the product.

10. A shower rinse system that blends a selected product with water and directs the blended solution through a shower head of a shower device, said shower rinse system comprising:

a shower stall containing a shower head, a flow injector in fluid communication with the shower head, a valve in fluid communication with the flow injector, and said valve in fluid communication with the selected product, wherein the valve releases a predetermined volume of the flow product to the flow injector, and a control means connected to the valve, wherein the control means is adapted to be remotely located from the shower device and external from said shower stall.

11. The shower rinse system as recited in claim 10, wherein the valve is a solenoid valve.

12. The shower rinse system as recited in claim 10, wherein the control means is a push-button switch.

13. The shower rinse system as recited in claim 10, wherein the control means transmits a signal to the valve to release said volume of the product.

14. The shower rinse system as recited in claim 10, wherein the flow injector comprising an inlet, and a first and second end defining a passage, wherein the first end is attached to one end of a shower arm and the opposite end of the shower arm is mounted to the shower head, and wherein the second end of the flow injector is connected to a water supply line and, wherein the valve comprising an inlet part and an outlet port.

15. The shower rinse system as recited in claim 14,further comprising a first flow tube and a second flow tube, wherein a first end of the first flow tube is connected to the inlet of the flow injector and a second end of the first flow tube is connected to the outlet port of the valve, and wherein a first end of the second flow tube is connected to the product supply source located external to said shower stall and a second end of the second flow tube is connected to the inlet port of the valve.

* * * * *